US012808357B2

(12) United States Patent
Jansen et al.

(10) Patent No.: US 12,808,357 B2
(45) Date of Patent: Nov. 24, 2026

(54) DOUBLE ACTING PUMP

(71) Applicant: MHWIRTH GMBH, Erkelenz (DE)

(72) Inventors: Roman Jansen, Wassenberg (DE); Norbert Jaeger, Heinsberg (DE)

(73) Assignee: MHWIRTH GMBH, Erkelenz (DE)

( * ) Notice: Subject to any disclaimer, the term of this patent is extended or adjusted under 35 U.S.C. 154(b) by 0 days.

(21) Appl. No.: 19/127,742

(22) PCT Filed: Sep. 1, 2023

(86) PCT No.: PCT/NO2023/060042
§ 371 (c)(1),
(2) Date: May 7, 2025

(87) PCT Pub. No.: WO2024/101998
PCT Pub. Date: May 16, 2024

(65) Prior Publication Data

US 2026/0177042 A1 Jun. 25, 2026

(30) Foreign Application Priority Data

Nov. 9, 2022 (NO) ..... 20221205

(51) Int. Cl.

| | |
|---|---|
| ***F04B 9/117*** | (2006.01) |
| ***F04B 23/06*** | (2006.01) |
| ***F04B 43/02*** | (2006.01) |
| ***F04B 43/067*** | (2006.01) |

(52) U.S. Cl.
CPC ..... *F04B 9/1172* (2013.01); *F04B 23/06* (2013.01); *F04B 43/026* (2013.01); *F04B 43/067* (2013.01)

(58) Field of Classification Search
CPC ..... F04B 9/1172; F04B 9/117; F04B 23/06; F04B 43/025; F04B 43/026; F04B 43/06; F04B 43/067
See application file for complete search history.

(56) References Cited

U.S. PATENT DOCUMENTS 3,363,575 A * 1/1968 Potts ..... F04B 9/113 417/397
4,710,104 A * 12/1987 Dring ..... F04B 9/113 417/342
5,165,869 A * 11/1992 Reynolds ..... F04B 43/009 417/388
5,588,808 A * 12/1996 De Santis ..... F15B 3/00 417/397

(Continued)

FOREIGN PATENT DOCUMENTS

CN 105971859 A 9/2016
CN 109519353 A 3/2019

(Continued)

*Primary Examiner* — Bryan M Lettman
(74) *Attorney, Agent, or Firm* — Norman B. Thot

(57) ABSTRACT

A pump includes a plurality of pump cylinders, an intake line, and a discharge line. Each pump cylinder of the plurality of pump cylinders has a piston arranged therein. Each piston divides an interior volume of a respective pump cylinder into a first working chamber and a second working chamber. Each first working chamber is operatively connected to the intake line and to the discharge line of a fluid to be pumped. Each second working chamber is fluidly connected to the first working chamber of another pump cylinder of the plurality of pump cylinders.

17 Claims, 8 Drawing Sheets

(56) References Cited

U.S. PATENT DOCUMENTS

| | | | | |
|---|---|---|---|---|
| 6,190,565 | B1 | 2/2001 | Bailey et al. | |
| 6,478,552 | B1 | 11/2002 | Batten et al. | |
| 8,920,146 | B2 | 12/2014 | Heinrichs | |
| 9,695,808 | B2 | 7/2017 | Giessbach et al. | |
| 2010/0014996 | A1 | 1/2010 | Wilmsen | |
| 2014/0161627 | A1* | 6/2014 | Sivaramakrishnan | F04B 9/113 417/2 |
| 2015/0260178 | A1 | 9/2015 | Giessbach | |
| 2015/0375249 | A1* | 12/2015 | Schenke | F04B 43/0736 222/1 |
| 2018/0112655 | A1* | 4/2018 | Reid | F04B 9/111 |
| 2020/0040886 | A1* | 2/2020 | Iversen | G05D 16/2033 |
| 2021/0231113 | A1 | 7/2021 | Jansen | |
| 2022/0186717 | A1 | 6/2022 | Jansen | |

FOREIGN PATENT DOCUMENTS

| | | | |
|---|---|---|---|
| DE | 1 811 697 | A1 | 6/1970 |
| WO | WO 2009/072896 | A1 | 6/2009 |
| WO | WO 2020/193151 | A1 | 10/2020 |

* cited by examiner

DOUBLE ACTING PUMP

CROSS REFERENCE TO PRIOR APPLICATIONS

This application is a U.S. National Phase application under 35 U.S.C. § 371 of International Application No. PCT/NO2023/060042, filed on Sep. 1, 2023 and which claims benefit to Norwegian Patent application No. 20221205, filed on Nov. 9, 2022. The International Application was published in English on May 16, 2024 as WO 2024/101998 A1 under PCT Article 21(2).

FIELD

The present invention relates to pumps, in particular but not exclusively to heavy duty fluid pumps for large scale applications.

BACKGROUND

Reciprocating pumps are used in a variety of applications and for a wide range of purposes. One such application is the conveyance of fluids in large-scale plants for earth drilling or mining. Some examples of such pumps and their application are described in U.S. Pat. No. 8,920,146 B2, US 2015/0260178 A1, WO 2020/193151 A1 and U.S. Pat. No. 9,695,808 B2. The type of pumps therein described are commonly used, for example, to pump mining slurry or drilling mud, i.e., fluid mixtures with demanding properties, for example, having a considerable amount of solid particles suspended therein.

Such pumps for the applications mentioned above or for other similar fields of use often have demanding operating conditions which may include requirements for high output pressures or flow rates and the need to handle challenging media, for example, abrasive liquids and/or liquids containing solid particles. Many such pumps are used in mobile or remote installations, for example, on drilling rigs, and have high demands for operational reliability and low maintenance requirements. There is furthermore a desire for compactness and low weight in most applications.

There is a continuous need for improved pump technology, for example, in the mining industry and for other heavy duty applications.

SUMMARY

An aspect of the present invention is to provide fluid pumps with improvements in one or more of the abovementioned aspects, or at least to provide useful alternatives to known technology.

In an embodiment, the present invention provides a pump which includes a plurality of pump cylinders, an intake line, and a discharge line. Each pump cylinder of the plurality of pump cylinders comprises a piston arranged therein. Each piston is configured to divide an interior volume of a respective pump cylinder into a first working chamber and a second working chamber. Each first working chamber is operatively connected to the intake line and to the discharge line of a fluid to be pumped. Each second working chamber is fluidly connected to the first working chamber of another pump cylinder of the plurality of pump cylinders.

The detailed description below provides further examples and embodiments.

BRIEF DESCRIPTION OF THE DRAWINGS

The present invention is described in greater detail below on the basis of embodiments and of the drawings in which.

DETAILED DESCRIPTION

The present invention provides a pump comprising a plurality of pump cylinders, each pump cylinder of the plurality of pump cylinders comprising a piston arranged therein, each piston dividing an interior volume of the pump cylinder into a first working chamber and a second working chamber; an intake line; and a discharge line, wherein each first working chamber is operatively connected to the intake line and to the discharge line of a fluid to be pumped, and each second working chamber is fluidly connected to a first working chamber of another pump cylinder of the plurality of pump cylinders.

Figure 1:
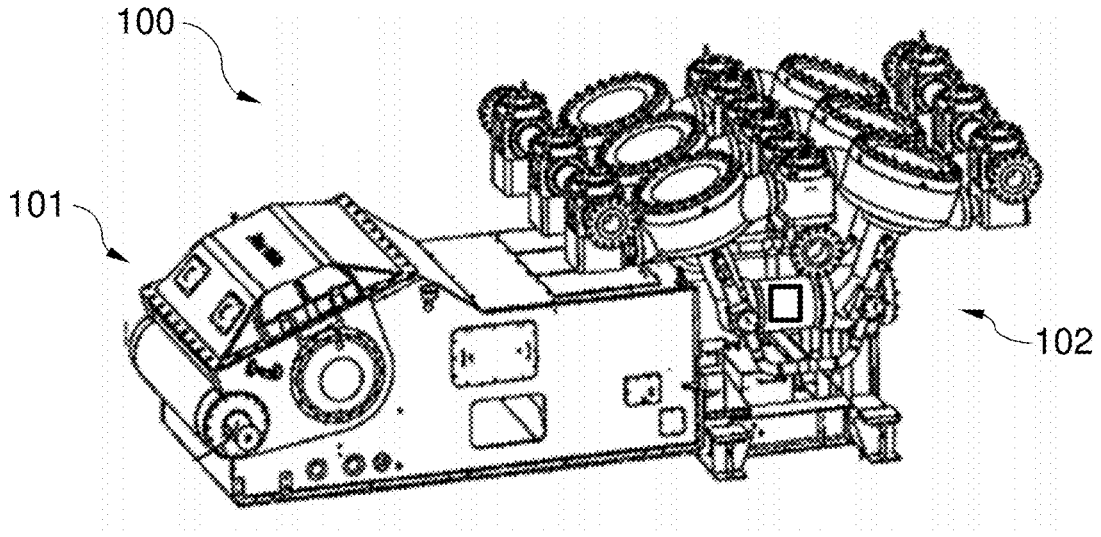
Fig. 1 (Prior Art)
FIG. 1 shows an example of a slurry pump according to the prior art.

FIG. 1 shows an example of a slurry pump 100 (see, for example, U.S. Pat. No. 9,695,808 B2). The pump 100 comprises a drive part 101, in this case a crank drive mechanism. The drive part 101 also includes a motor, such as an electric motor, to drive the crank drive mechanism. The pump 100 also comprises a pump part 102 having a plurality of pump cylinder units, in this example, three pump cylinders driving six diaphragm pump chambers. The pump cylinder units have pistons (not visible in FIG. 1) driven by the crank drive mechanism, for example, in the manner described below.

Pumps such as the slurry pump 100 shown in FIG. 1 are typically used to transport slurries or other fluids containing solids. These pumps may have power ratings of several hundred kilowatts or more, and each diaphragm housing and corresponding diaphragm may have a diameter of one meter or more.

Figure 2:
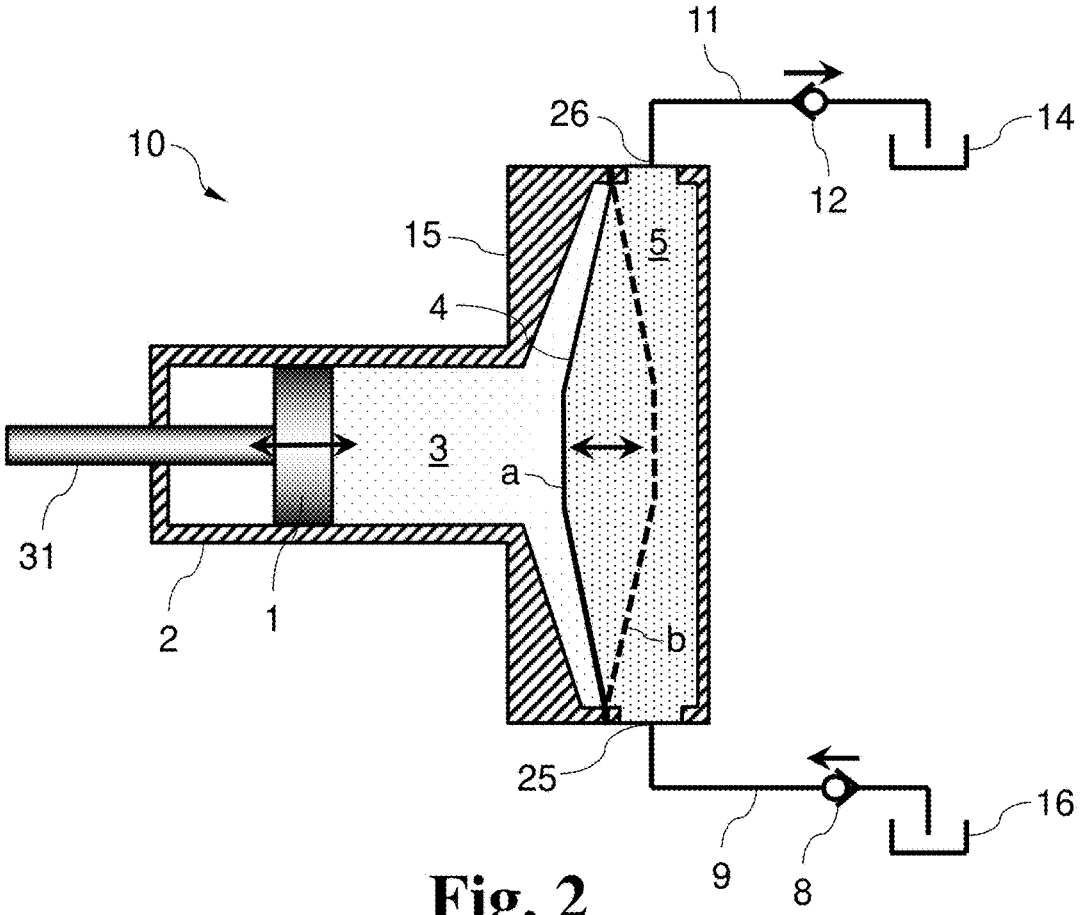
Fig. 2 (Prior Art)
FIG. 2 shows a schematic view of the operational principle of a piston diaphragm pump according to the prior art.

FIG. 2 illustrates the principal design and operation of a piston diaphragm pump, in this case a single-acting pump. FIG. 2 illustrates one pump cylinder unit 10. The pump cylinder unit 10 has a piston 1 (or an equivalent drive element, such as a plunger) which is driven by a drive unit (not shown) via a piston rod 31 in an oscillating motion. The piston 1 thereby moves back and forth within a pump cylinder 2 (as indicated by the double arrow). The drive unit may, for example, be a crank system. By this movement, the piston 1 displaces a volume of fluid in an intermediate fluid chamber 3, usually a hydraulic oil. The intermediate fluid chamber 3 is delimited by the piston 1, a pump chamber housing 15 (which may or may not include or be integral with the pump cylinder 2), and a flexible, fluid-impermeable separation diaphragm 4 (also denoted as membrane). Via the flexible separation diaphragm 4, the fluid chamber 3 is fluidly separated from, but operatively connected to, a pump chamber 5, which contains a medium to be pumped. The medium may, for example, be a mud or a slurry. The movement of the piston 1 causes a displacement of fluid in (or into and out of) the intermediate fluid chamber 3, which again causes a back-and-forth displacement of the separation diaphragm 4 (as indicated by the double arrow), and thereby an increase or reduction in the volume of the pump chamber 5. The separation diaphragm 4 moves between its outer positions a and b. The end stroke position "a" illustrates the end of a suction stroke/start of a discharge stroke, while the end stroke position "b" (which is shown as a dashed line) illustrates the end of a discharge stroke/start of a suction stroke.

The pump chamber 5 has an inlet 25 and is fluidly connected to a fluid source 16 via an intake line 9 having an intake line valve 8. The fluid source 16 may, for example, be a pit or a pipe system supplying fluid to be transported by the pump 100, such as a slurry. The pump chamber 5 further has an outlet 26 which is fluidly connected to a fluid receiver 14 (for example, a fluid reservoir or piping system for conveying the pumped fluid for further transport) via a discharge line 11, which has a discharge line valve 12. The pressure in the fluid receiver 14 during ordinary operation is higher than at the fluid source 16.

The intake line valve 8 and the discharge line valve 12 are typically passive one-way valves but may, however, optionally be of a different type, e.g., actively controlled valves. Via the oscillating movement of the piston 1 and the resulting volume change of the pump chamber 5, the fluid to be pumped is sucked via the intake line valve 8, into the pump chamber 5, and then compressed. When the pressure in the pump chamber 5 and the discharge line 11 upstream the discharge line valve 12 exceeds that of the fluid receiver 14, the discharge line valve 12 opens (or is opened), and the pumped fluid is conveyed from the pump chamber 5 to the fluid receiver 14.

Figure 3:
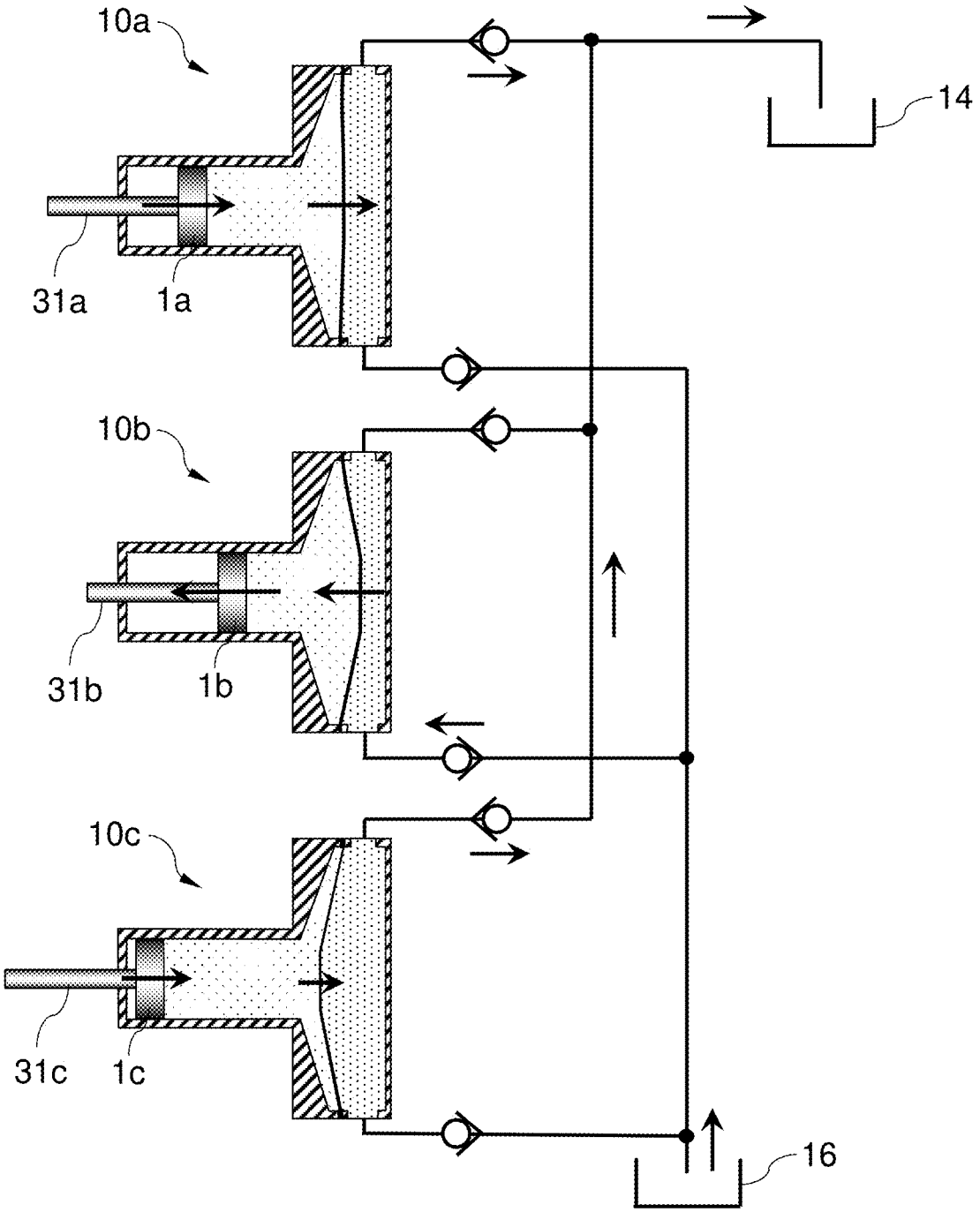
Fig. 3 (Prior Art)
FIG. 3 is a schematic view of the operational principle of a single acting triplex piston diaphragm pump according to the prior art.

FIG. 3 illustrates the operational principle of a single acting triplex piston diaphragm pump according to the prior art. The triplex piston diaphragm pump comprises three pump cylinder units 10*a-c*, each of which is designed and operates as described in relation to pump cylinder unit 10 described above. The three pistons 1*a-c* are driven by piston rods 31*a-c*, for example, via a crank drive mechanism. The crank drive mechanism will typically be arranged so that there is an operational phase shift of 120 degrees between the three pump cylinder units 10*a-c*. In FIG. 3, the arrows illustrate the instant mechanical and fluid motions in the system at an exemplary point in time; FIG. 3 illustrates the pump cylinder unit 10*a* carrying out a discharge stroke, pump cylinder unit 10*b* carrying out a suction stroke, and the pump cylinder unit 10*c* carrying out a discharge stroke.

Figure 4:
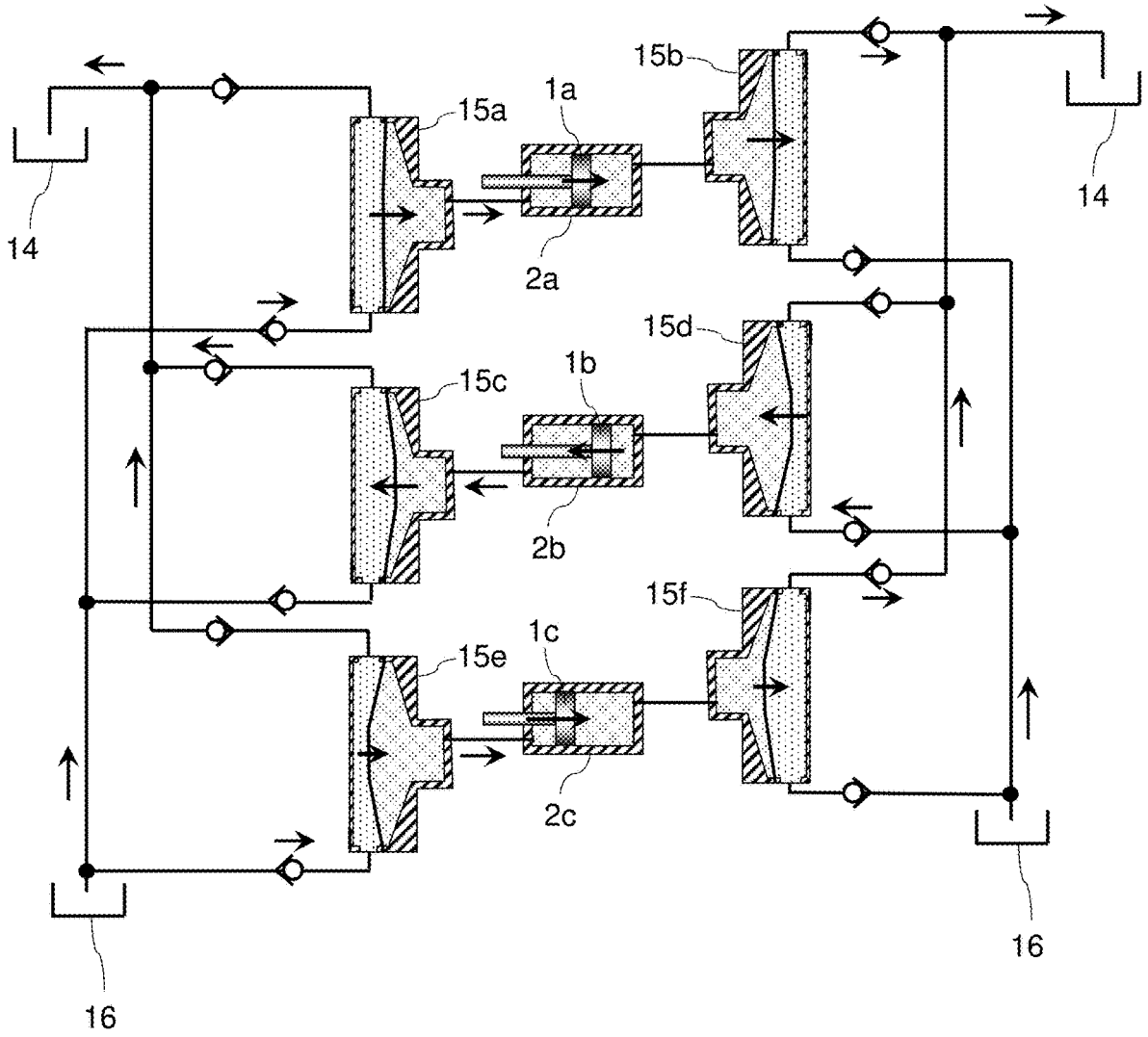
Fig. 4 (Prior Art)
FIG. 4 is a schematic view of the operational principle of a double acting triplex pump according to the prior art.

FIG. 4 illustrates the operational principle of a double acting triplex pump according to the prior art. In this arrangement, each pump cylinder 2*a-c* comprises a double acting piston 1*a-c*, where each side of the piston 1*a-c* is operatively connected to a pump chamber housing 15*a-f*. This arrangement of the pump part 102 is that used in the pump 100 illustrated in FIG. 1. The arrows in FIG. 4 indicate an example of motions and fluid flows at one point in time during operation of the pump. Unlike in the single acting pump, the piston rod side of the piston(s) 1*a-c* are utilized for pumping fluid in a double acting pump. Although a higher pumped volume flow is possible with such a double-acting arrangement, the constructive complexity of the pump is a drawback. The arrangement shown requires 6 diaphragms, with associated housings, and 12 valves. This adds complexity at the pump part 102, for example, reducing accessibility for maintenance and increasing manufacturing costs.

Figure 5:
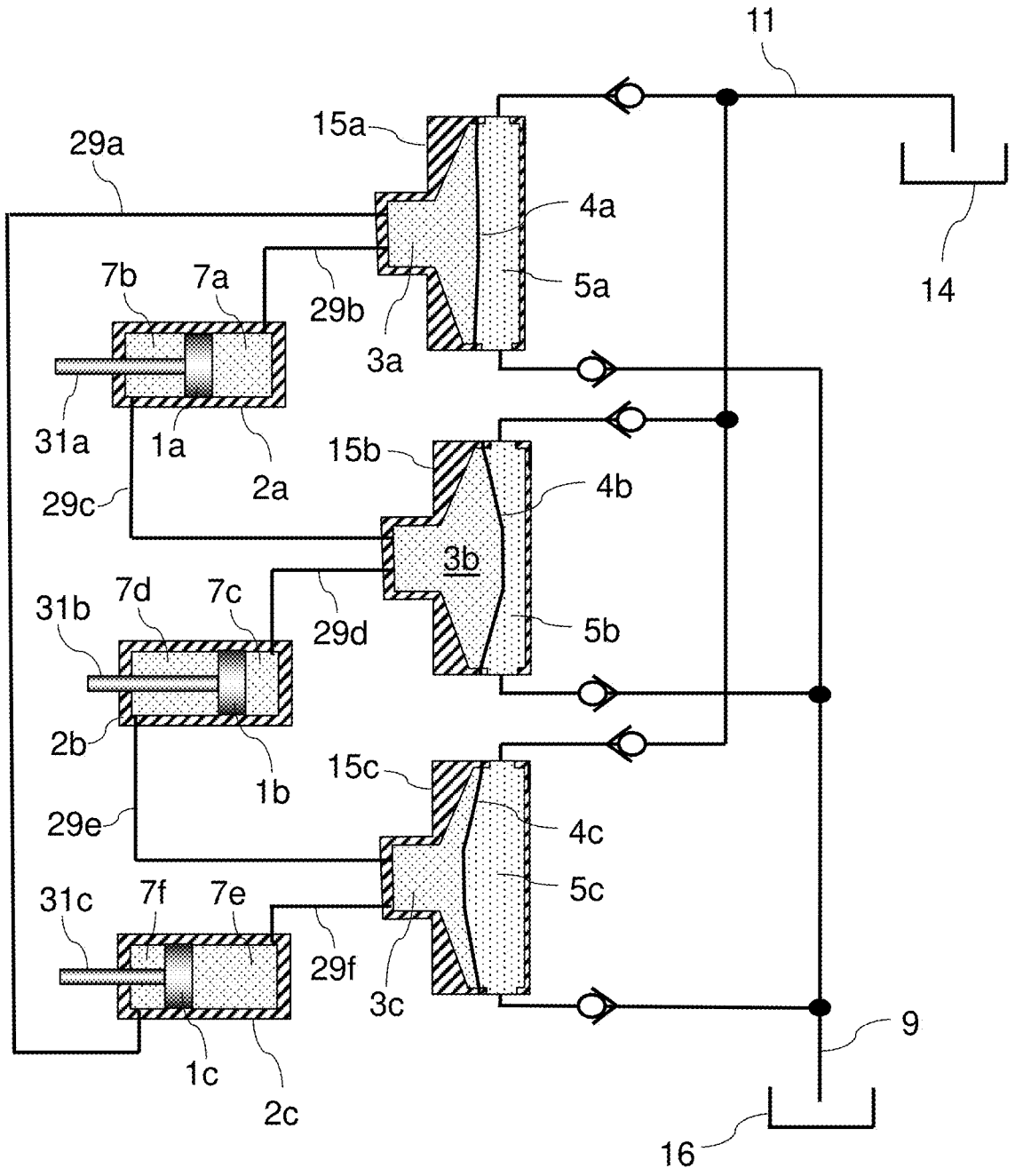
FIG. 5 is a schematic view of the operational principle of a three-cylinder double acting diaphragm pump according to an example of the present invention.

FIG. 5 is a schematic view of the operational principle of a three-cylinder double acting diaphragm pump according to an embodiment of the present invention. Items of similar function as described above are given the same reference numeral.

In the embodiment of FIG. 5, the pump has three pump chamber housings 15*a-c*, each of which have a diaphragm 4*a-c* arranged therein. The pump chamber housings 15*a-c* may be separate housing structures, or they may be integrally formed as a common pump chamber housing structure defining several interior volumes therein. The diaphragms 4*a-c* separate an interior volume of each pump chamber housing 15*a-c* into a pump chamber 5*a-c* and an intermediate fluid chamber 3*a-c*, and each of the pump chambers 5*a-c* is operatively connected to intake line 9 and the discharge line 11 via respective valves so as to receive and discharge the fluid to be pumped (for example, a slurry or mud). The intake line 9 and the discharge line 11 may, for example, be pipes forming part of the pump 100 and having interfaces (such as connectors) to an external piping system.

Three pump cylinders 2*a-c* are arranged with double acting pistons 1*a-c* defining two working chambers 7*a-f* in the respective pump cylinder 2*a-c*. The pistons 1*a-c* are operatively connected to a crank mechanism 30 (see FIG. 7) which is configured to drive the pistons 1*a-c* in the pump cylinders 2*a-c* via a piston rod 31*a-c*. The piston rods 31*a-c* extend out of the pump cylinder 2*a-c* so that each piston 1*a-c* defines one piston side working chamber 7*a,c,e* and one rod side working chamber 7*b,d,f*.

Each of the intermediate fluid chambers 3*a-c* is fluidly connected to two separate working chambers 7*a-f* in different pump cylinders 2*a-c*. The fluid connections are two-way connections, for example, via pipes or channels, so that the working fluid can flow freely between the intermediate chambers 3*a-c* and working chambers 7*a-f* according to the motion of the pistons 1*a-c* and the pressure levels in the system. The fluid connections are pipes 29*a-f* in the illustrated embodiment.

As the pistons 1*a-c* are driven in a reciprocating manner, working fluid will be displaced into or out of the intermediate chambers 3*a-c*, and thereby effectuate a reciprocating motion of the diaphragms 4*a-c*, thereby driving alternating suction and discharge strokes in the pump chambers 5*a-c*. Pumped fluid will thereby be transported from the fluid source 16 to the fluid receiver 14.

As can be seen from FIG. 5, the second working chambers 7*b,d,f* are in this example fluidly connected to a respective first working chamber 7*a,c,e* of another pump cylinder 2*a-c* via one of the intermediate fluid chambers 3*a-c*. The second working chambers 7*b,d,f* may alternatively be directly connected to a respective first working chamber 7*a,c,e*, for example, via a dedicated pipe or fluid channel therefor (similar to the arrangement of pump cylinders 2*a-c* shown in FIG. 10).

Figure 6:
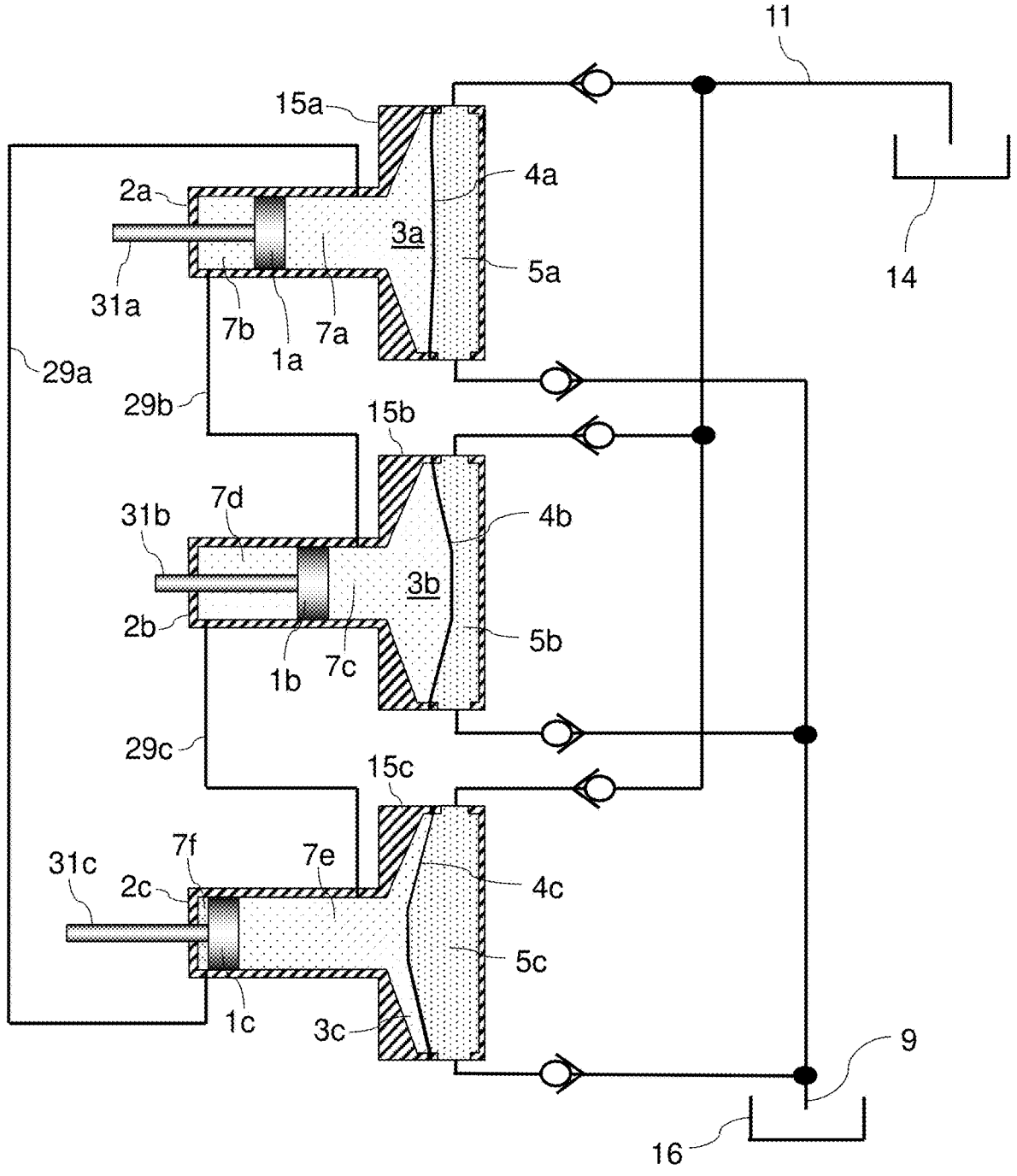
FIG. 6 is a schematic view of the operational principle of a three-cylinder double acting diaphragm pump according to an example of the present invention.

FIG. 6 illustrates another embodiment of the present invention wherein each pump chamber housing 15*a-c* is integral with a respective pump cylinder 2*a-c*. In this configuration, the working chambers 7*a,c,e* and the intermediate fluid chambers 3*a-c* are formed as a common chamber. The rod side chambers 7*b,d,f* are connected to a respective piston side chamber 7*a,c,e* and/or intermediate fluid chamber 3*a-c* via fluid lines or pipes 29*a-c* which may, for example, be hydraulic pipes or channels, such as machined channels in the housing structure. The functionality and operation is otherwise the same as described in relation to FIG. 5.

Each intermediate fluid chamber 3*a-c* is advantageously connected to one piston side working chamber 7*a,c,e* and one rod side working chamber 7*b,d,f* of a different pump cylinder 2*a-c*. For example, as shown in FIG. 5, intermediate fluid chamber 3*b* may be connected to piston side working chamber 7*c* in pump cylinder 2*b* and rod side working chamber 7*b* in pump cylinder 2*a*. This may provide advantages in relation to volume flows in that the phase shift between the working chambers is more beneficial. In a three-cylinder embodiment, and with the crank mechanism 30 arranged to drive the pistons 1*a-c* with a 120 degree phase shift (as is the common arrangement in a three-cylinder pump), the piston side chamber and the rod side chamber will operate with a phase shift of approximately 60° between them to supply the same intermediate fluid chamber 3*a-c*. See also FIG. 8.

Figure 7:
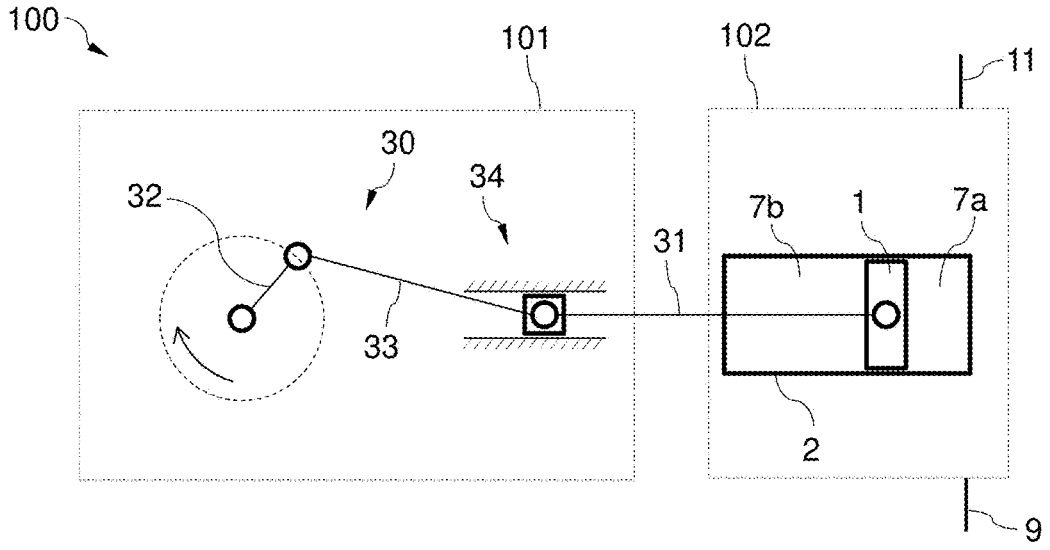
FIG. 7 is an illustration of a pump arrangement of the present invention.

FIG. 7 is an illustration of a pump 100 having a drive part 101 and a pump part 102. See also, generally, FIG. 1. The pump part 102 comprises a plurality of pump cylinders 2*a-c* and related components, along with interfaces to the intake line 9 and discharge line 11, as described above and below. The drive part 101 may comprise a crank mechanism 30 with a crankshaft 32 interconnected with a connecting rod 33 to drive each piston 1 via a piston rod 31. A crosshead mechanism 34 may be provided so as to allow the piston rod 31 to move fully linearly in a reciprocating manner. The crankshaft 32 may be driven by an appropriate motor, such as an electric motor arranged in or as a part of the drive part 101. The crank mechanism 30 is arranged to drive all the pistons 1, 1*a-d* of the pump 100. The crankshaft 32 is for this purpose designed with an appropriate phase shift between each connecting rod interface. A pump with three pump cylinders 2*a-c* (a triplex pump) may have a phase shift of 120 degrees between each piston 1*a-c*. A pump with four pump cylinders 2*a-d* may have a phase shift of 90 degrees between each piston 1*a-d*.

The pump 100 further comprises a pump part 102 comprising the plurality of pump cylinders 2*a-d* and associated components. The pump part 102 may comprise an arrangement such as that described in the embodiments herein, for example, such as the embodiments illustrated in FIGS. 5, 6, 9 and 10.

Figure 8:
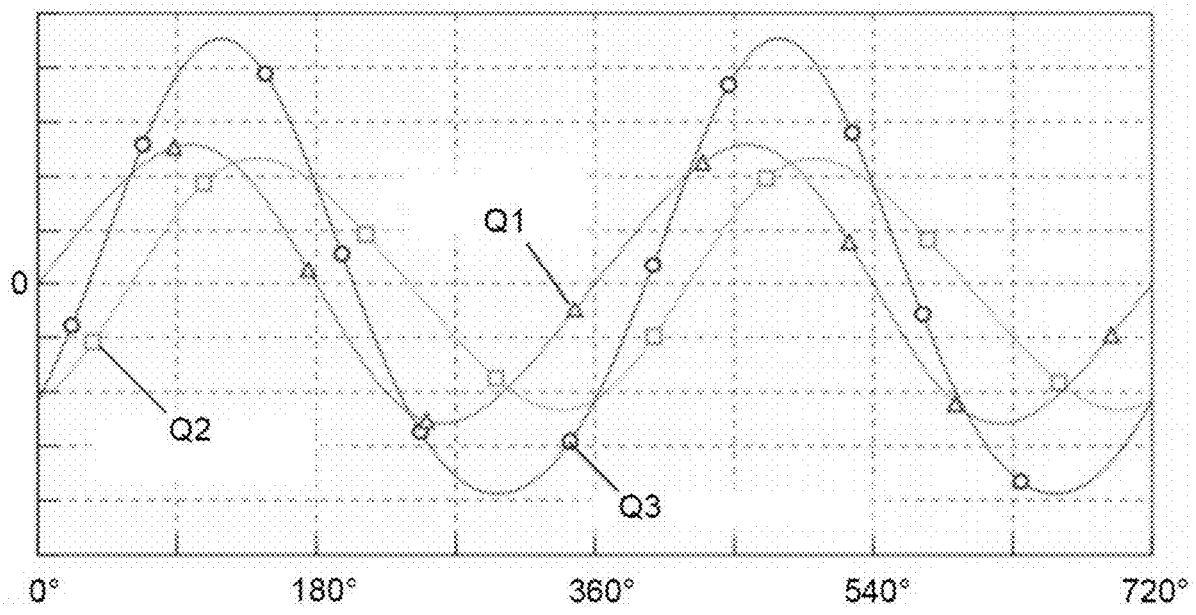
FIG. 8 is an illustration of volume displacement rates of two interconnected working chambers in a pump according to an example of the present invention.

FIG. 8 is an illustration of volume displacement rates of two interconnected working chambers in a pump according to an embodiment of the present invention. In FIG. 8, the vertical (y) axis illustrates the rate of displacement, for example, in liters ($dm^3$) per second, while the horizontal (x) axis illustrates the revolution of the crank mechanism 30.

FIG. 8 illustrates the displacement rates over two crank revolutions of the pump 100, and for two interconnected working chambers in a triplex (three-cylinder) pump such as the one illustrated in FIG. 5. Graph Q1 illustrates the volume displacement rate in a piston side working chamber, for example, chamber 7*c* in FIG. 5. Graph Q2 illustrates the volume displacement rate in a rod side working chamber, for example, chamber 7*b* in FIG. 5. Graph Q3 illustrates the combined volume displacement rates, i.e., the sum of graphs Q1 and Q2. Referring still to FIG. 5 and chambers 7*b* and 7*c* as an example, graph Q3 would thereby represent the volumetric flow rate of working fluid being provided to intermediate chamber 3*b*. As can be seen, the total flow rate (Q3) in this arrangement is higher than that obtained from a single working chamber (e.g., chamber 7*c*, graph Q1). Graph Q1 alone would be representative for the volumetric displacement in a single acting triplex pump such as the prior art pump of FIG. 3.

Figure 9:
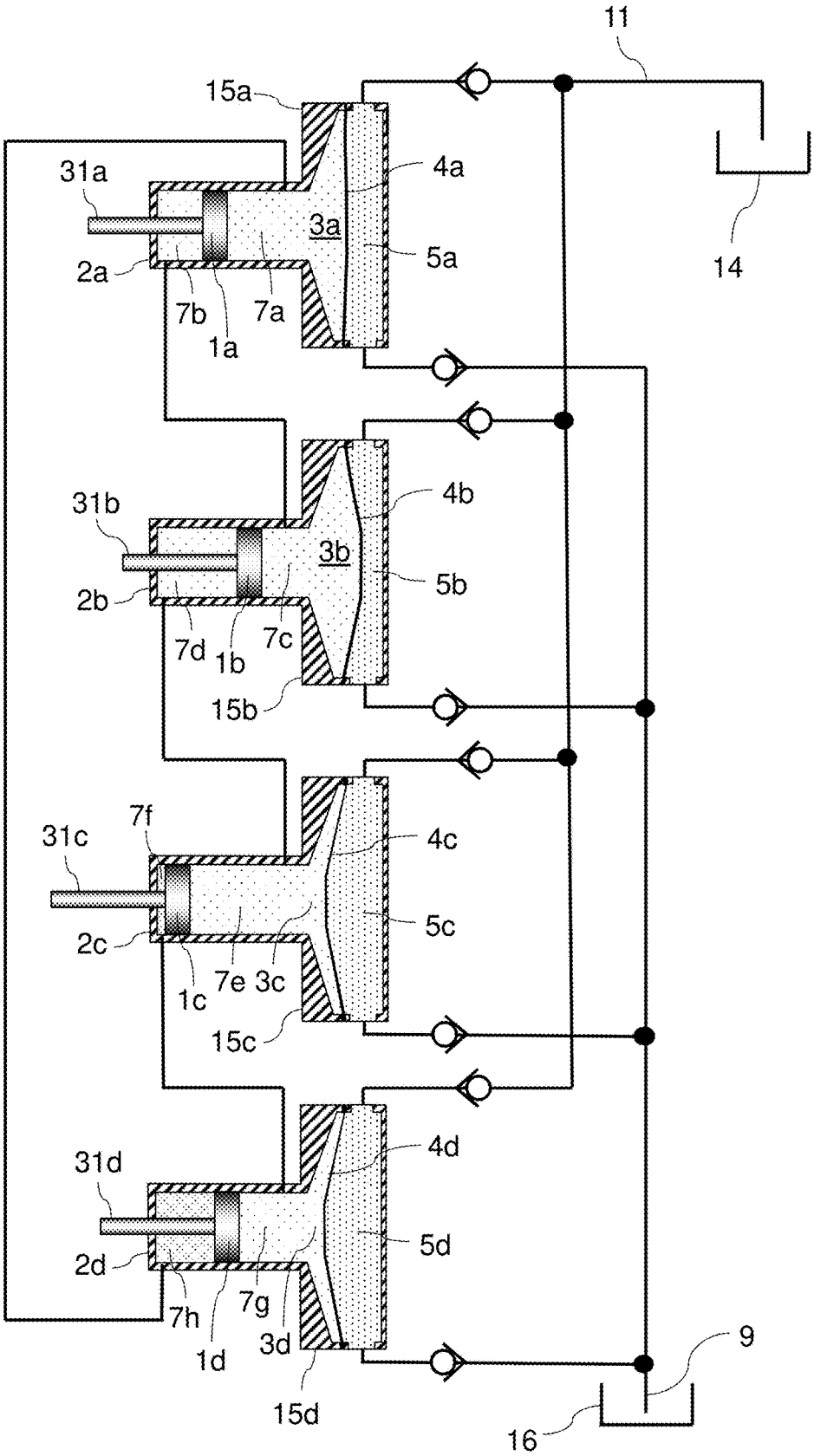
FIG. 9 illustrates a four-cylinder double acting diaphragm pump according to an example of the present invention.

FIG. 9 illustrates a four-cylinder double acting diaphragm pump according to an embodiment of the present invention. Except for the number of cylinders and associated components, the arrangement is similar to that illustrated in FIG. 6, with the same reference numerals used for corresponding components.

Figure 10:
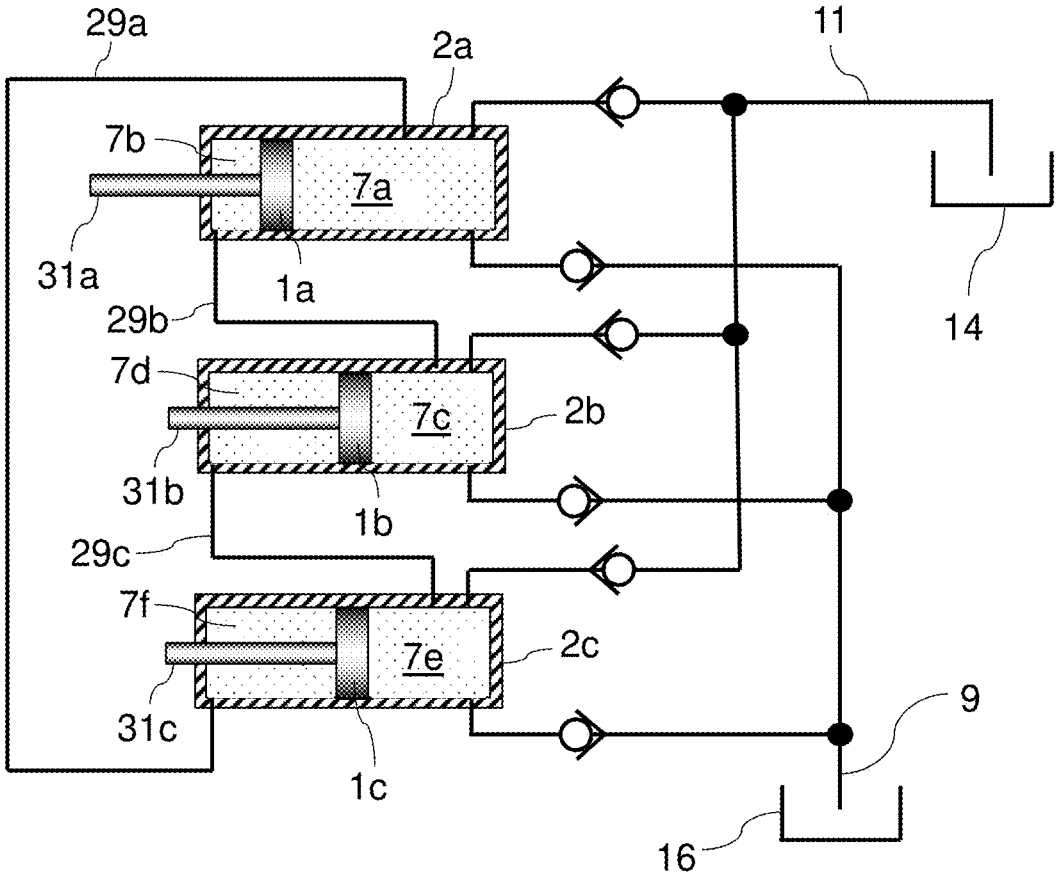
FIG. 10 illustrates a three-cylinder double acting pump according to an example of the present invention.

FIG. 10 illustrates a three-cylinder double acting pump according to another embodiment of the present invention. In this embodiment, the pump does not employ a diaphragm as in the embodiments above but operates directly on the fluid to be pumped. The working chambers 7*a,c,e* are for this purpose directly connected to the intake line 9 and discharge line 11 so as to receive fluid to be pumped in the first working chambers 7*a,c,e*. Each of the rod side working chambers 7*b,d,f* is fluidly connected to a respective working chamber 7*a,c,e* of another one of the pump cylinders 2*a-c* via fluid lines or pipes 29*a-c*. For this three-cylinder (triplex) embodiment, the volumetric delivery flow rate profile of the pump is substantially equivalent to that described in relation to FIG. 8 above, i.e., an enhanced total flow rate compared to a single-acting pump with the same piston/cylinder dimensions.

In any of the embodiments described herein, the fluid lines or pipes 29*a-f* are two-way, open fluid connections, i.e., free of valves or other dedicated flow restrictions.

In any of the embodiments described herein, the pump cylinders 2*a-d* and pump cylinder chambers 7*a-g* may be ring-coupled so that each pump cylinder 2*a-d* is sequentially interconnected with each other and the last pump cylinder 2*c*, 2*d* is connected to the first pump cylinder 2*a*.

The pump 100 may, for example, have exactly three pump cylinders 2*a-c*, as illustrated in FIGS. 5,6 and 10, and wherein:

- a second chamber 7*b* of the first pump cylinder 2*a* is connected to a first chamber 7*c* of the second pump cylinder 2*b*,
- a second chamber 7*d* of the second pump cylinder 2*b* is connected to a first chamber 7*e* of the third pump cylinder 2*c*, and
- a second chamber 7*f* of the third pump cylinder 2*c* is connected to a first chamber 7*a* of the first pump cylinder 2*a*.

Alternatively, the pump 100 may, for example, have exactly four pump cylinders 2*a-d*, as illustrated in FIG. 9, and wherein:

- a second chamber 7*b* of the first pump cylinder 2*a* is connected to a first chamber 7*c* of the second pump cylinder 2*b*,
- a second chamber 7*d* of the second pump cylinder 2*b* is connected to a first chamber 7*e* of the third pump cylinder 2*c*,
- a second chamber 7*f* of the third pump cylinder 2*c* is connected to a first chamber 7*g* of the fourth pump cylinder 2*d*, and
- a second chamber 7*h* of the fourth pump cylinder 2*d* is connected to a first chamber 7*a* of the first pump cylinder 2*a*.

Each of working chambers 7*a,c,e* or 7*a,c,e,g* may be piston side chambers, and each of working chambers 7*b,d,f* or 7*b,d,f,h* may be rod side chambers.

The embodiments described herein may be particularly suitable for large-scale pump system, for example, a pump system for transporting muds or slurries. In any of the embodiments described herein, the pistons 1*a-d* may have a diameter larger than 300 mm, for example, larger than 400 mm, for example, larger than 500 mm, for example, larger than 600 mm. In any of embodiments described herein, each separation diaphragm 4*a-d* may have a diameter larger than 500 mm, for example, larger than 600 mm, for example, larger than 750 mm, for example, larger than 1000 mm, and/or an area larger than 0.2 $m^2$, for example, larger than 0.5 $m^2$. In any of the embodiments described herein, the pump may have a design output of more than 250 KW, for example, more than 500 kW, for example, more than 1000 kW pumping power. In any of the embodiments described herein, the pump may be a pump for pumping slurry or drilling mud. In any of the embodiments described herein, the maximum design outlet pressure of the pump may, for example, be more than 30 bar (3000 kPa), for example, more than 75 bar (7500 kPa), for example, more than 100 bar (10,000 kPa).

The skilled reader will understand that the specific design of a pump may be adapted to a given use case, for example, in relation to the number of cylinders, the sizing of components, etc. According to examples and embodiments described herein, high pumped flow rates can be obtained while keeping the pump compact and with a low number of moving parts. Examples and embodiments can provide lower construction complexity, for example, with a reduced number of valves and, in a diaphragm pump, the number of diaphragms/membranes and associated housings and piping can be kept low. This may reduce manufacturing and maintenance costs and improve operational reliability. In some examples, when compared to a single-acting pump, a higher pump flow rate can be obtained using smaller pistons 1*a-d*, thereby reducing pump size and manufacturing costs.

The present invention is not limited by the embodiments described above; reference should be had to the appended claims.

The following numbered clauses outline further inventive examples and embodiments according to the present disclosure:

Clause 1: A pump (100) comprising:

a plurality of pump cylinders (2*a-d*), each pump cylinder (2*a-d*) of the plurality of pump cylinders (2*a-d*) comprising a piston (1*a-d*) arranged therein, each piston (1*a-d*) dividing an interior volume of the pump cylinder (2*a-d*) into a first working chamber (7*a,c,e,g*) and a second working chamber (7*b,d,f,h*);

an intake line (9); and a discharge line (11), wherein, each first working chamber (7*a,c,e,g*) is operatively connected to the intake line (9) and to the discharge line (11) of a fluid to be pumped, and each second working chamber (7*b,d,f,h*) is fluidly connected to a first working chamber (7*a,c,e,g*) of another pump cylinder of the plurality of pump cylinders (2*a-d*).

Clause 2: The pump (100) as recited in any preceding clause, wherein each second working chamber (7*b,d,f,h*) is fluidly connected to exactly one first working chamber (7*a,c,e,g*) of another pump cylinder of the plurality of pump cylinders (2*a-d*).

Clause 3: The pump (100) as recited in any preceding clause, wherein the fluid connection of each second working chamber (7*b,d,f,h*) to a first working chamber (7*a,c,e,g*) of another pump chamber of the plurality of pump cylinders (2*a-d*) is a direct connection.

Clause 4: The pump (100) as recited in any preceding clause, wherein the plurality of pump cylinders (2*a-d*) consists of three pump cylinders or of four pump cylinders or of more than four pump cylinders.

Clause 5: The pump (100) as recited in any preceding clause, wherein the operative connection of each first working chamber (7*a,c,e,g*) to the intake line (9) and to the discharge line (11) is a direct connection, respectively.

Clause 6: The pump (100) as recited in any preceding clause, the pump (100) comprising a plurality of diaphragms (4*a-d*), wherein each of the first working chambers (7*a,c,e,g*) is operatively connected to the fluid intake and discharge lines (9,11) via a respective diaphragm (4*a-d*).

Clause 7: The pump (100) as recited in any preceding clause, wherein the diaphragms (4*a-d*) are arranged in a pump chamber housing (15*a-d*), each diaphragm (4*a-d*) dividing a respective interior volume (3*a-d*,5*a-d*) of the pump chamber housing (15*a-d*) into a pump chamber (5*a-d*) and an intermediate fluid chamber (3*a-d*), and wherein, each of the first working chambers (7*a,c,e,g*) is fluidly connected to an intermediate fluid chamber (3*a-d*), and the intake line (9) and the discharge line (11) are fluidly connected to the pump chambers (5*a-d*).

Clause 8: The pump (100) as recited in any preceding clause, wherein each intermediate fluid chamber (3*a-d*) is fluidly connected to the first working chamber (7*a,c,e,g*) and to the second working chambers (7*b,d,f,h*) of two different pump cylinders (2*a-d*) of the plurality of pump cylinders (2*a-d*).

Clause 9: A pump comprising:

at least one pump chamber housing (15*a-d*);

a plurality of pump cylinders (2*a-d*), each pump cylinder of the plurality of pump cylinders (2*a-d*) comprising a piston (1*a-d*) having a piston rod (31*a-d*) attached thereto, the piston rod (31*a-d*) being configured to extend out of the pump cylinder (2*a-d*), the piston (1*a-d*) dividing the pump cylinder into a first working chamber (7*a,c,e,g*) on a side of the piston (1*a-d*) where the piston rod (31*a-d*) is not arranged, and a second working chamber (7*b,d,f,h*) on a side of the piston (1*a-d*) wherein the piston rod (31*a-d*) is arranged;

a plurality of diaphragms (4*a-d*) arranged in the pump chamber housing(s) (15*a-d*), one respective diaphragm (4*a-d*) of the plurality of the diaphragms (4*a-d*) being arranged to divide the first working chamber (7*a,c,e,g*) from a pump chamber (5*a-d*);

an intake line (9); and a discharge line (11), wherein, each pump chamber (5*a-d*) is operatively connected to the intake line (9) and to the discharge line (11) of a fluid to be pumped, and each second working chamber (7*b,d,f,h*) is fluidly connected to exactly one first working chamber (7*a,c,e,g*) of another pump cylinder of the plurality of pump cylinders (2*a-d*).

Clause 10: A pump comprising:

at least one pump chamber housing (15*a-d*);

a plurality of diaphragms (4*a-d*), one respective diaphragm (4*a-d*) of the plurality of the diaphragms (4*a-d*) being arranged in a respective interior volume (3*a-d*, 5*a-d*) of the at least one pump chamber housing (15*a-d*), each diaphragm (5*a-d*) being configured to divide an intermediate fluid chamber (3*a-d*) from a pump chamber (5*a-d*) in the at least one pump chamber housing (15*a-d*);

a plurality of pump cylinders (2*a-d*), each pump cylinder of the plurality of pump cylinders (2*a-d*) comprising a piston (1*a-d*) having a piston rod (31*a-d*) attached thereto, the piston rod (31*a-d*) being configured to extend out of the pump cylinder (2*a-d*), the piston (1*a-d*) dividing the pump cylinder into a first working chamber (7*a,c,e,g*) on a side of the piston (8*a-d*) where the piston rod (31*a-d*) is not arranged, and a second working chamber (7*b,d,f,h*) on a side of the piston (1*a-d*) wherein the piston rod (31*a-d*) is arranged;

an intake line (9); and a discharge line (11), wherein, each pump chamber (5*a-d*) is operatively connected to the intake line (9) and to the discharge line (11) of a fluid to be pumped, and each intermediate fluid chamber (3*a-d*) is fluidly connected to the first working chamber (7*a,c,e,g*) and to the second working chambers (7*b,d,f,h*) of two different pump cylinders (2*a-d*) of the plurality of pump cylinders (2*a-d*).

Clause 11: The pump (100) as recited in any preceding clause, further comprising:

a plurality of crank mechanisms (30), wherein, each respective one of the plurality of crank mechanisms (30) is configured to drive one respective piston (1*a-d*).

Clause 12: The pump (100) as recited in any preceding clause, wherein each respective one of the plurality of crank mechanisms (30) is configured to drive the one respective piston (1*a-d*) with a phase shift with respect to another or each other piston (1*a-d*).

Clause 13: The pump (100) as recited in any preceding clause, wherein the plurality of crank mechanisms (30) is interconnected by a common crankshaft (32).

Clause 14: The pump (100) as recited in any preceding clause, wherein the phase shift between each piston (1*a-d*) is 360° divided by a number of the plurality of pump cylinders (2*a-d*).

Clause 15: The pump (100) as recited in any preceding clause, wherein each pump chamber (5*a-d*) is operatively connected to the intake line (9) and to the discharge line (11) via valves (8,12).

Clause 16: The pump (100) as recited in any preceding clause, further comprising:

a plurality of piston rods (31*a-d*), wherein, each piston (1*a-d*) has one piston rod of the plurality of piston rods (31*a-d*) attached thereto so that the one respective piston rod extends out of the respective one of the plurality of pump cylinders (2*a-d*).

Clause 17: The pump (100) as recited in any preceding clause, wherein each second working chamber (7*b,d,f,h*) is provided as a piston rod side chamber.

Clause 18: The pump (100) as recited in any preceding clause, wherein each pump cylinder (2*a-d*) is formed integrally with a pump chamber housing (15*a-d*).

Clause 19: The pump (100) as recited in any preceding clause, wherein the pump comprises exactly three pump cylinders (2*a-d*) or exactly four pump cylinders (2*a-d*).

Clause 20: The pump (100) as recited in any preceding clause, wherein the number of diaphragms (4*a-d*) equals the number of pump cylinders (2*a-d*).

Clause 21: The pump (100) as recited in any preceding clause, wherein each intermediate fluid chamber (3*a-d*) is connected to one piston side working chamber (7*a,c,e,g*) and one rod side working chamber (7*b,d,f,h*) of the pistons (1*a-d*).

Clause 22: The pump (100) as recited in any preceding clause, wherein each intermediate fluid chamber (3*a-d*) is fluidly connected to two different pump cylinders (2*a-d*).

Clause 23: The pump (100) as recited in any preceding clause, wherein the second working chambers (7*b,d,f,h*) are fluidly connected to a respective first working chamber (7*a,c,e,g*) of another one of the pump cylinders (2*a-d*) via one of the intermediate fluid chambers (3*a-d*).

Clause 24: The pump (100) as recited in any preceding clause, wherein each second working chamber (7*b,d,f,h*) is fluidly connected to exactly one first working chamber (7*a,c,e,g*) of another pump cylinder of the plurality of pump cylinders (2*a-d*).

Clause 25: The pump (100) as recited in any preceding clause, wherein the pump has exactly three pump cylinders (2*a-d*), and, a second chamber (7*b*) of the first pump cylinder (2*a*) is connected to a first chamber (7*c*) of the second pump cylinder (2*b*), a second chamber (7*d*) of the second pump cylinder (2*b*) is connected to a first chamber (7*e*) of the third pump cylinder (2*c*), and a second chamber (7*f*) of the third pump cylinder (2*c*) is connected to a first chamber (7*a*) of the first pump cylinder (2*a*).

Clause 26: The pump (100) as recited in any preceding clause, wherein the pump has exactly four pump cylinders (2*a-d*), and, a second chamber (7*b*) of the first pump cylinder (2*a*) is connected to a first chamber (7*c*) of the second pump cylinder (2*b*), a second chamber (7*d*) of the second pump cylinder (2*b*) is connected to a first chamber (7*e*) of the third pump cylinder (2*c*), a second chamber (7*f*) of the third pump cylinder (2*c*) is connected to a first chamber (7*g*) of the fourth pump cylinder (2*d*), and a second chamber (7*h*) of the fourth pump cylinder (2*d*) is connected to a first chamber (7*a*) of the first pump cylinder (2*a*).

Clause 27: The pump (100) as recited in any preceding clause, wherein each of the first working chambers (7*a,c,e,g*) is a piston side chamber, and each of the second working chambers (7*b,d,f,h*) is a rod side chamber.

LIST OF REFERENCE CHARACTERS

| | |
|---|---|
| 100 | Pump/Slurry pump |
| 101 | Drive part |
| 102 | Pump part |
| 1, 1a-d | Piston |
| 2, 2a-d | Pump cylinder |
| 3, 3a-d | Intermediate fluid chamber |
| 4, 4a-d | Separation diaphragm/Membrane |
| 5, 5a-d | Pump chamber |
| 7 | Working chamber |
| 7a, c, e, g | First working chamber |
| 7b, d, f, h | Second working chamber |
| 8 | Intake line valve |
| 9 | Intake line |

-continued

| LIST OF REFERENCE CHARACTERS | |
|---|---|
| 10, 10a-c | Pump cylinder unit |
| 11 | Discharge line |
| 12 | Discharge line valve |
| 14 | Fluid receiver |
| 15, 15a-f | Pump chamber housing |
| 16 | Fluid source |
| 25 | Inlet |
| 26 | Outlet |
| 29a-f | Pipe/Fluid line |
| 30 | Crank mechanism |
| 31, 31a-d | Piston rod |
| 32 | Crankshaft |
| 33 | Connecting rod |
| 34 | Crosshead mechanism |
| a | End of suction stroke/Start of discharge |
| b | End of discharge stroke/Start of suction stroke |

What is claimed is:

1. A pump comprising:

a plurality of pump cylinders, each pump cylinder of the plurality of pump cylinders comprising a piston arranged therein, each piston being configured to divide an interior volume of a respective pump cylinder into a first working chamber and a second working chamber;

an intake line; and a discharge line, wherein, each first working chamber is operatively connected to the intake line and to the discharge line of a fluid to be pumped, and each second working chamber is fluidly connected to the first working chamber of another pump cylinder of the plurality of pump cylinders.

2. The pump as recited in claim 1, wherein each second working chamber is fluidly connected to exactly one first working chamber of another pump cylinder of the plurality of pump cylinders.

3. The pump as recited in claim 1, wherein the plurality of pump cylinders consists of three pump cylinders, of four pump cylinders, or of more than four pump cylinders.

4. The pump as recited in claim 1, wherein, the operative connection of each first working chamber to the intake line is a respective direct connection, and the operative connection of each first working chamber to the discharge line is a respective direct connection.

5. The pump as recited in claim 1, further comprising:

a plurality of crank mechanisms, wherein, each respective one of the plurality of crank mechanisms is configured to drive one respective piston.

6. The pump as recited in claim 5, wherein each respective one of the plurality of crank mechanisms is further configured to drive the one respective piston with a phase shift with respect to each other piston.

7. The pump as recited in claim 6, wherein the phase shift between each piston is 360° divided by a number of the plurality of pump cylinders.

8. The pump as recited in claim 1, further comprising:

a plurality of pump chamber housings, each respective pump chamber housing of the plurality of pump chamber housings being associated with at least one pump cylinder of the plurality of pump cylinders, a plurality of diaphragms, one respective diaphragm of the plurality of diaphragms being arranged in one respective pump chamber housing of the plurality of pump chamber housings so as to divide an interior volume of each respective pump chamber housing into a pump chamber and an intermediate fluid chamber, wherein, a respective first working chamber is fluidly connected to a respective intermediate fluid chamber, and the intake line and the discharge line are fluidly connected to each pump chamber.

9. The pump as recited in claim 8, wherein each intermediate fluid chamber is fluidly connected to the first working chamber and to the second working chamber of two different pump cylinders of the plurality of pump cylinders.

10. The pump as recited in claim 8, further comprising:

a plurality of piston rods, wherein, each respective piston rod of the plurality of piston rods has a piston attached thereto so that the one respective piston rod extends out of the respective one of the plurality of pump cylinders.

11. The pump as recited in claim 10, wherein each second working chamber is provided as a piston rod side chamber.

12. The pump as recited in claim 11, wherein, each first working chamber is provided as a piston side working chamber, and each intermediate fluid chamber is connected to one piston side working chamber and to one rod side working chamber.

13. The pump as recited in claim 8, wherein each respective intermediate fluid chamber is fluidly connected to two different pump cylinders of the plurality of pump cylinders.

14. The pump as recited in claim 8, wherein each second working chamber of a pump cylinder of the plurality of pump cylinders is fluidly connected to the first working chamber of another one of the pump cylinders of the plurality of pump cylinders via one of the respective intermediate fluid chambers.

15. The pump as recited in claim 1, wherein, the plurality of pump cylinders is provided as exactly three pump cylinders consisting of a first pump cylinder comprising a first chamber and a second chamber, a second pump cylinder comprising a first chamber and a second chamber, and a third pump cylinder comprising a first chamber and a second chamber, the second chamber of the first pump cylinder is connected to the first chamber of the second pump cylinder, the second chamber of the second pump cylinder is connected to the first chamber of the third pump cylinder, and the second chamber of the third pump cylinder is connected to the first chamber of the first pump cylinder.

16. A pump comprising:

at least one pump chamber housing;

a plurality of pump cylinders, each pump cylinder of the plurality of pump cylinders comprising a piston arranged therein, each piston comprising a piston rod attached thereto, each piston rod being configured to extend out of a respective pump cylinder of the plurality of pump cylinders, each piston being configured to divide a respective pump cylinder of the plurality of pump cylinders into a first working chamber which is arranged on a side of the piston where the piston rod is not arranged, and a second working chamber which is arranged on a side of the piston wherein the piston rod is arranged;

a plurality of diaphragms arranged in the at least one pump chamber housing, each respective diaphragm of the plurality of diaphragms being arranged to divide a respective first working chamber from a respective pump chamber;

an intake line; and a discharge line, wherein, each pump chamber is operatively connected to the intake line and to the discharge line of a fluid to be pumped, and each second working chamber is fluidly connected to exactly one first working chamber of another pump cylinder of the plurality of pump cylinders.

17. A pump comprising:

at least one pump chamber housing;

a plurality of diaphragms, each respective diaphragm of the plurality of diaphragms being arranged in a respective interior volume of the at least one pump chamber housing, each respective diaphragm being configured to divide a respective intermediate fluid chamber from a respective pump chamber in the at least one pump chamber housing;

a plurality of pump cylinders, each pump cylinder of the plurality of pump cylinders comprising a piston arranged therein, each piston comprising a piston rod attached thereto, each piston rod being configured to extend out of a respective pump cylinder of the plurality of pump cylinders, each piston being configured to divide a respective pump cylinder of the plurality of pump cylinders into a first working chamber which is arranged on a side of the piston where the piston rod is not arranged, and a second working chamber which is arranged on a side of the piston wherein the piston rod is arranged;

an intake line; and a discharge line, wherein, each pump chamber is operatively connected to the intake line and to the discharge line of a fluid to be pumped, and each intermediate fluid chamber is fluidly connected to the first working chamber and to the second working chamber of two different pump cylinders of the plurality of pump cylinders.

* * * * *